US008356561B2

(12) United States Patent
Stiedl

(10) Patent No.: US 8,356,561 B2
(45) Date of Patent: Jan. 22, 2013

(54) SIDE WALL FOR A RAIL VEHICLE

(75) Inventor: Hans Stiedl, Rheinberg (DE)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 13/029,150

(22) Filed: Feb. 17, 2011

(65) Prior Publication Data

US 2012/0210907 A1 Aug. 23, 2012

(51) Int. Cl.
*B61D 17/00* (2006.01)

(52) U.S. Cl. ..... 105/404; 105/409; 105/401

(58) Field of Classification Search ..... 105/409, 105/404, 401; 52/459–472, 474–761
See application file for complete search history.

(56) References Cited

U.S. PATENT DOCUMENTS

| | | | | | |
|---|---|---|---|---|---|
| 2,323,316 | A * | 7/1943 | Dieter | 52/518 |
| 3,713,679 | A * | 1/1973 | Beschmann et al. | 52/45 |
| 3,774,553 | A * | 11/1973 | Kunst et al. | 105/401 |
| 4,158,465 | A * | 6/1979 | Fenner et al. | 296/203.03 |
| 5,613,726 | A * | 3/1997 | Hobbs et al. | 296/186.1 |
| 5,690,035 | A * | 11/1997 | Hatayama et al. | 105/452 |
| 5,979,335 | A * | 11/1999 | Saxton et al. | 105/404 |
| 6,065,261 | A * | 5/2000 | Fehr et al. | 52/580 |
| 6,302,031 | B1 * | 10/2001 | Smith et al. | 105/404 |
| 2006/0277859 | A1 * | 12/2006 | Egli et al. | 52/730.4 |
| 2011/0253006 | A1 * | 10/2011 | Han et al. | 105/409 |

FOREIGN PATENT DOCUMENTS

| | | | |
|---|---|---|---|
| DE | 102005008062 | A1 * | 8/2006 |
| DE | 102007035772 | A1 * | 2/2009 |
| DE | 102009007711 | A1 * | 8/2010 |
| EP | 1688626 | A1 * | 8/2006 |
| WO | WO 2010009946 | A1 * | 1/2010 |

* cited by examiner

*Primary Examiner* — Jason C Smith

(57) ABSTRACT

A side wall for a rail vehicle is provided. The side wall includes a plurality of profiles which are arranged vertically one above the other. A sliding seat is formed between two adjacent profiles. A first profile of the adjacent profiles has, on an outer side of the side wall, a welding projection, and a second profile of the adjacent profiles has a welding projection which is dimensioned to reach a predefined overall side wall height. The two adjacent profiles are welded to one another on the outer side of the side wall via a V-seam.

2 Claims, 1 Drawing Sheet

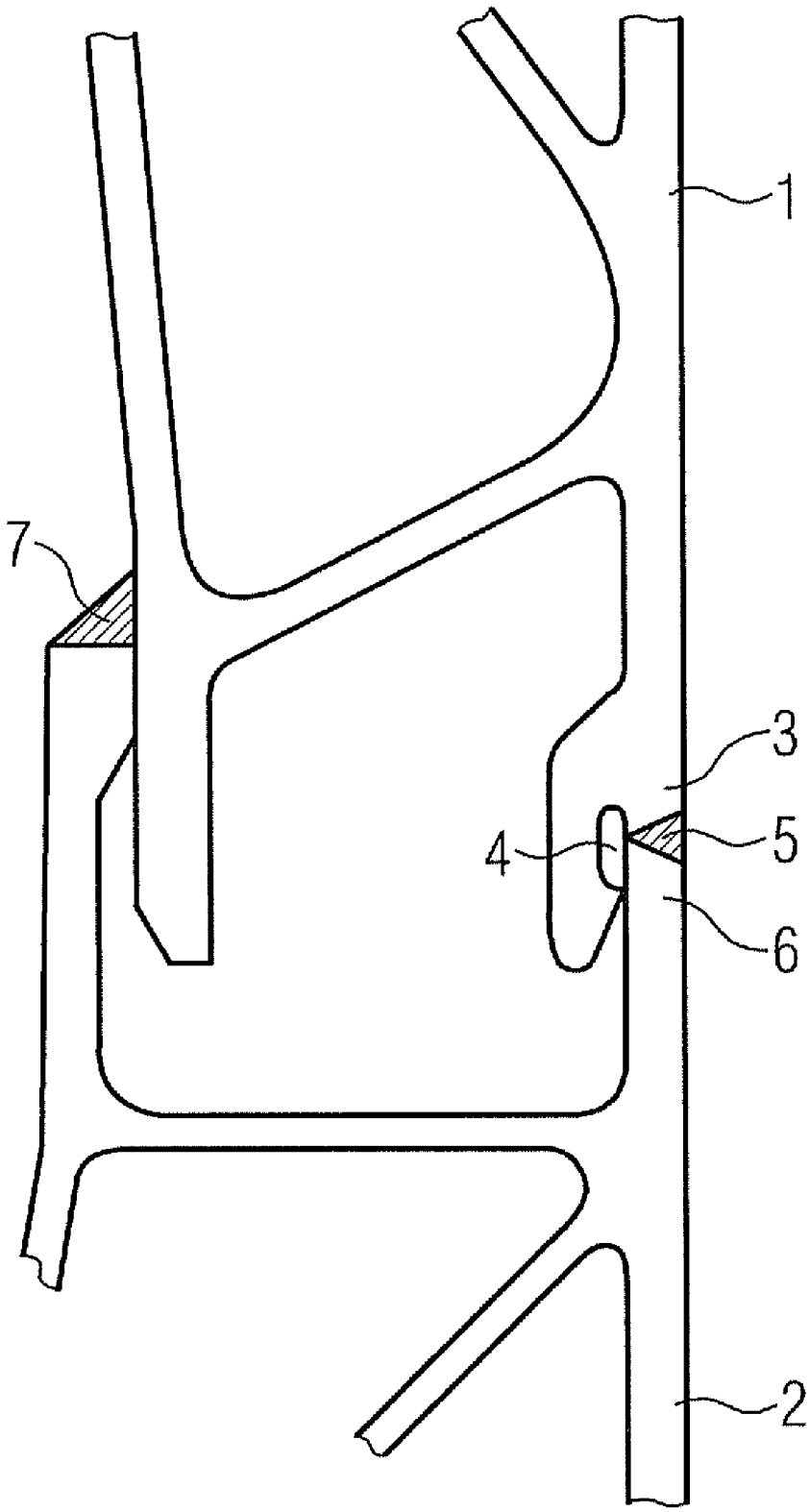
1
7
3
4
5
6
2

SIDE WALL FOR A RAIL VEHICLE

FIELD OF INVENTION

The invention relates to a side wall for a rail vehicle, which is composed of a plurality of profiles which are arranged vertically one above the other and in which a sliding seat is formed between two adjacent profiles.

SUMMARY OF INVENTION

A side wall for a rail vehicle is generally composed of five metal profiles, in particular aluminum profiles, which are arranged vertically one above the other. If these five metal profiles are welded to one another without vertical compensating means, subsequent height tolerances may be produced:

If each of the metal profiles has a height tolerance of ±2.5 mm, an overall tolerance is ±12.5 mm. In addition there is welding seam shrinkage, which is −4 mm. This means that the entire side wall height tolerance is +8.5/−16.5 mm. This large tolerance range is structurally unacceptable, so that tolerance compensation is absolutely necessary.

In order to provide the tolerance compensating means it is customary to provide a sliding seat between two adjacent metal profiles. In order to implement the sliding seat, the two adjacent metal profiles can be slid one into the other. After the desired overall height of the side wall has been set, the two adjacent profiles are respectively welded on the inner side and outer side with a fillet seam.

This procedure has the consequence that a low-lying groove is produced on an outer side of the side wall in the visible region, and said groove has to be filled in before the side wall is painted.

An object of the claimed invention is to specify a side wall for a rail vehicle, wherein post-processing work on the outer side of the side wall is reduced before painting.

This object is achieved in the case of the side wall mentioned at the beginning by virtue of the fact that a first profile of the adjacent profiles has, on an outer side of the side wall, a welding projection and a second profile of the adjacent profiles has a welding projection which is dimensioned to reach a predefined overall side wall height, and the two adjacent profiles are welded to one another on the outer side of the side wall by means of a V seam.

Owing to the fact that there is a V seam on the outer side of the side wall instead of a fillet seam, the low-lying groove which is disadvantageous in the prior art is no longer produced. It is therefore possible, if appropriate, to dispense with post-processing of the outer side of the side wall completely before painting.

The replacement of the fillet seam by the V seam also has static and weight advantages.

The welding projection of the second profile of the adjacent profiles may be given excessively long dimensions in an initial state so that the necessary vertical compensation can be brought about by suitably milling off this welding projection.

The first profile of the adjacent profiles preferably engages under the second profile of the adjacent profiles on the outer side of the side wall so as to form a cavity underneath the V seam. This ensures favorable welding conditions for the production of the V seam.

The two adjacent profiles can be welded to one another on an inner side of the welding seam by means of a fillet seam. In this context, the first profile and the second profile of the adjacent profiles may overlap on the inner side of the side wall to a degree that permits the predefined overall side wall height to be set by means of vertical displacement of the adjacent profiles.

All in all, the overall height of the side wall is therefore determined by adapting the length of the excessively long welding projection of the second metal profile, while on the inner side of the side wall the first metal profile is inserted to a corresponding degree into the second metal profile.

BRIEF DESCRIPTION OF THE DRAWINGS

An exemplary embodiment of the invention will be explained in more detail below with reference to the drawing. The single FIGURE shows a cross-sectional view of a junction region between two adjacent metal profiles of a side wall of a rail vehicle.

DETAILED DESCRIPTION OF INVENTION

The FIGURE shows a first upper aluminum profile 1 and a second lower aluminum profile 2, which are arranged adjacent to one another. The two metal profiles 1, 2 are the uppermost two profiles of, for example, a total of 5 metal profiles, which together form the side wall of a rail vehicle.

The metal profiles 1, 2 which are shown are embodied in such a way that they permit the implementation of a sliding seat for the vertical adjustment of the side wall. For this purpose, the first metal profile 1 has a pressed-on welding projection 3, specifically on an outer side of the finished side wall. Furthermore, the first metal profile 1 engages under the second metal profile 2 on the outer side of the side wall so as to form a cavity 4 underneath a V seam 5. The first metal profile 1 bears on the other side of the V seam 5 on an associated welding projection 6 of the second metal profile 2.

The length of the welding projection 6 is dimensioned here in such a way that a desired overall height of the side wall is produced. For this purpose, the height of the four lower metal profiles which are already welded to one another can be determined first. The necessary position for the fifth, uppermost metal profile, in the present exemplary embodiment the first metal profile 1, is then obtained from the value of the difference between this height and the desired overall height. The welding projection 6, which is excessively long in the initial state, of the second metal profile 2 is adjusted to a desired length after the necessary measurements have been taken, after which necessary welded connections between the first and the second metal profiles 1, 2 can be performed. This results, in particular, in the V seam 5, which has already been referred to, on the outer side of the side wall, said V seam 5 being already suitable for a subsequent painting process.

On an inner side of the side wall, the first metal profile 1 and the second metal profile 2 are connected to one another using a fillet seam 7. In this context, the first and the second of the adjacent metal profiles 1, 2 overlap on the inner side of the side wall to a degree that permits the predefined overall side wall height to be set by means of vertical displacement of the adjacent profiles. In particular, the first metal profile on the inner side of the side wall is inserted into the second metal profile 2 to the extent which results from the position of the welding projections 3, 6 on the outer side of the side wall.

The invention claimed is:

1. A side wall for a rail vehicle, comprising:

a plurality of profiles which are arranged vertically one above the other, wherein the plurality of profiles forms the side wall of the rail vehicle; and a sliding seat formed between each of the plurality of profiles, wherein a first profile includes, on an outer side of the side wall, a first welding projection, a second profile includes a second welding projection which is dimensioned to reach a predefined overall side wall height, the first and second profiles are welded to one another on the outer side of the side wall via a V-seam, wherein the first profile engages under the second profile on the outer side of the side wall so as to form a cavity underneath the V-seam, and wherein the overall side wall height is determined by adapting a length of the second welding projection of the second profile, while on an inner side of the side wall the first profile is inserted into the second profile.

2. The side wall as claimed in claim 1, wherein the first and second profiles are welded to one another on the inner side of the side wall via a fillet-seam.

* * * * *